US010724349B2

(12) United States Patent
Osen

(10) Patent No.: US 10,724,349 B2
(45) Date of Patent: Jul. 28, 2020

(54) SUBSEA WELLHEAD ASSEMBLY

(71) Applicant: STATOIL PETROLEUM AS, Stavanger (NO)

(72) Inventor: Per Osen, Oslo (NO)

(73) Assignee: STATOIL PETROLEUM AS, Stavanger (NO)

( * ) Notice: Subject to any disclaimer, the term of this patent is extended or adjusted under 35 U.S.C. 154(b) by 0 days.

(21) Appl. No.: 15/545,051

(22) PCT Filed: Dec. 24, 2015

(86) PCT No.: PCT/NO2015/050262

§ 371 (c)(1),
(2) Date: Jul. 20, 2017

(87) PCT Pub. No.: WO2016/118019

PCT Pub. Date: Jul. 28, 2016

(65) Prior Publication Data

US 2018/0003008 A1 Jan. 4, 2018

(30) Foreign Application Priority Data

Jan. 20, 2015 (GB) ..... 1500951.7
Feb. 3, 2015 (GB) ..... 1501776.7

(51) Int. Cl.
*E21B 33/035* (2006.01)
*E21B 33/037* (2006.01)
(Continued)

(52) U.S. Cl.
CPC ..... *E21B 41/08* (2013.01); *E21B 33/035* (2013.01); *E21B 33/037* (2013.01); *E21B 33/038* (2013.01); *E21B 33/064* (2013.01)

(58) Field of Classification Search
CPC .... E21B 33/035; E21B 33/038; E21B 33/064; E21B 41/08; E21B 33/037
See application file for complete search history.

(56) References Cited

U.S. PATENT DOCUMENTS 3,308,880 A 3/1967 Yetman
4,461,354 A * 7/1984 Buras ..... E21B 19/16 166/343

(Continued)

FOREIGN PATENT DOCUMENTS

EP 2 138 472 10/1984
GB 2 132 670 7/1984

(Continued)

OTHER PUBLICATIONS

International Search Report dated Apr. 6, 2016 in International Application No. PCT/NO2015/050262.

(Continued)

*Primary Examiner* — Matthew R Buck
(74) *Attorney, Agent, or Firm* — Wenderoth, Lind & Ponack, L.L.P.

(57) ABSTRACT

A subsea wellhead assembly 1 comprises: a subsea wellhead 2; a template 6 associated with the wellhead; subsea riser system equipment 4 connected to the wellhead and one or more connection members. The subsea riser system equipment 4 is also connected to the template 6 by the one or more connection members so that lateral support is provided to the subsea riser system equipment 4 from the template. A method of installing the subsea wellhead assembly 1 is also provided.

18 Claims, 6 Drawing Sheets

(51) Int. Cl.

| | |
|---|---|
| ***E21B 33/038*** | (2006.01) |
| ***E21B 33/064*** | (2006.01) |
| ***E21B 41/08*** | (2006.01) |

(56) References Cited

U.S. PATENT DOCUMENTS

| | | | | |
|---|---|---|---|---|
| 4,537,533 | A | 8/1985 | Hampton | |
| 4,597,350 | A * | 7/1986 | Mott | B63B 22/021 114/230.13 |
| 4,822,212 | A * | 4/1989 | Hall | E02D 23/16 166/359 |
| 5,788,417 | A * | 8/1998 | Fontenot | B63B 21/50 166/368 |
| 8,833,287 | B2 * | 9/2014 | Mogedal | E21B 41/08 114/294 |
| 9,074,447 | B1 * | 7/2015 | Cox | E02D 27/525 |
| 9,080,408 | B2 * | 7/2015 | Mogedal | E21B 19/002 |
| 9,845,654 | B2 * | 12/2017 | Hopper | E21B 33/037 |
| 2006/0042800 | A1 * | 3/2006 | Millheim | E21B 33/035 166/344 |
| 2007/0187109 | A1 | 8/2007 | Millheim et al. | |
| 2010/0294505 | A1 * | 11/2010 | Sbordone | E21B 43/013 166/349 |
| 2014/0374115 | A1 * | 12/2014 | Kebadze | E21B 41/04 166/345 |
| 2014/0374116 | A1 | 12/2014 | Kelso et al. | |

FOREIGN PATENT DOCUMENTS

| | | |
|---|---|---|
| WO | 2005/007978 | 1/2005 |
| WO | 2010/103002 | 9/2010 |
| WO | 2012/065896 | 5/2012 |
| WO | 2013/050411 | 4/2013 |

OTHER PUBLICATIONS

Written Opinion of the International Searching Authority dated Apr. 6, 2016 in International Application No. PCT/NO2015/050262.
Patents Act 1977: Search Report under Section 17 dated Mar. 2, 2015 in corresponding Application No. GB1500951.7.
Patents Act 1977: Search Report under Section 17 dated Jun. 29, 2016 in corresponding Application No. GB1522889.3.
Third Party Observation issued Jun. 5, 2017 in United Kingdom Patent Application No. 1522889.3.
Third Party Observation issued May 19, 2017 in International (PCT) Application No. PCT/NO2015/050262.

* cited by examiner

SUBSEA WELLHEAD ASSEMBLY

The invention relates to a subsea wellhead assembly and a method of installing a subsea wellhead assembly.

A typical subsea assembly comprises a subsea wellhead to which subsea riser system equipment, such as a blowout preventer and/or a Christmas tree (which may also be referred to as a subsea tree) may be connected. The subsea riser system equipment connected (downwards) to the wellhead is typically connected (upwards) to a riser that extends between this riser system equipment and a surface facility. The riser typically provides a conduit for the drill string and drilling fluids between the subsea well and the surface facility.

It is important that the wellhead assembly integrity is maintained so that structural failure and uncontrolled release of well fluids does not occur. As a result, it is desirable that forces that act on the assembly have as low risk as possible of damaging the assembly.

In a first aspect the present invention provides a subsea wellhead assembly, the assembly comprising: a subsea wellhead; a template associated with the wellhead; and subsea riser system equipment connected to the wellhead; wherein the subsea riser system equipment is also connected to the template so that lateral support is provided to the subsea riser system equipment.

The subsea wellhead assembly may comprise one or more connection members (i.e. support members), and the subsea riser system equipment may also be connected to the template by the support member(s) so that lateral support is provided to the subsea riser system equipment from the template.

In a second aspect, the present invention provides a method of installing a subsea wellhead assembly, the method comprising: providing a subsea wellhead, a template associated with the wellhead, and subsea riser system equipment connected to the wellhead; and connecting the subsea riser system equipment to the template so that lateral support is provided to the subsea riser system equipment.

Connecting the subsea riser system equipment to the template may be using one or more connection (i.e. support) members so that lateral support is provided to the subsea riser system equipment from the template.

Connecting the subsea riser system equipment to the template may occur after the subsea system equipment is connected to the wellhead.

With the present invention, because the subsea riser system equipment, e.g. blowout preventer (BOP), is connected to the template, it is possible for the template to provide lateral support to the riser system equipment, e.g. BOP, connected to the wellhead. This support may be provided during drilling, completion, and/or workover modes of operation of the wellhead assembly.

With the present invention the likelihood of structural failure of the wellhead assembly due to high static or variable loads may be maintained as low as possible.

The present invention may provide a method of controlling (e.g. reducing and/or minimising) the loads imposed for example by a drilling facility, etc., on a subsea wellhead.

The assembly may be for, or used for, reducing riser system induced load effects on the subsea wellhead. Thus the present invention may be considered to provide an assembly or a method for reducing riser system induced load effects in subsea wellheads.

The support/connection member(s) may be for reducing riser system induced load effects on the subsea wellhead.

By lateral support it may be meant that the riser system equipment is supported in a direction that is substantially parallel (or at least partially parallel) to the sea bed or substantially perpendicular to the axis of the wellhead. When the riser system equipment is connected to the substantially vertical wellhead, the lateral direction may be substantially horizontal.

If the wellhead (to which the riser system equipment is connected) is connected to the template, the connection between the subsea riser system equipment and the template may be in addition to the indirect connection via the wellhead, between the subsea riser system equipment and the template.

With this arrangement, because the subsea riser system equipment (e.g. the BOP) is laterally supported, it is possible for the loads transferred to the wellhead from the riser system (which includes the riser and the riser system equipment) to be reduced (e.g. substantially reduced), for example loads due to riser system equipment or riser movements. These loads may be cyclic fatigue loads and/or accidental or abnormally high single-loads. The assembly may reduce the loads transferred to the wellhead from the riser system equipment by 25% or more or 50% or more, (e.g. at least 25%, at least 30%, at least 40%, at least 50%, 50% to 60%, at least 60% or at least 75%) compared to a situation without such lateral support.

The connection (i.e. support) member(s) may be arranged so that they are able to reduce the bending moments exerted on the wellhead by the riser system equipment by at least 50%.

The connection (i.e. support) member(s) may be arranged so that they increase the stiffness of the assembly. The total lateral (horizontal) support stiffness may be between 5E+6 N/m to 20E+6 N/m. This may be the stiffness for an assembly with 4 to 8 connection members. This may be the stiffness on the level of the attachment points. This may be the stiffness when the unfavourable effect of template flexibility is included.

The load distribution between 1) the wellhead, and 2) the template and the connection members may depend on the relative stiffness between these two parts.

At least 40%, or at least 60% of the loads may be transferred from the wellhead to the connection members and template. The reduction in loads on the wellhead may depend on the connection members used. For example, if the connection members comprise soft synthetic fibre ropes the loads on the wellhead may be reduced by about 40%. If the connection members comprise steel rope lines the loads on the wellhead may be reduced by about 50 to 75%.

If the stiffness is too high this may impose too high loads on the connection points. If the stiffness is too low, the assembly may not provide sufficient load reduction.

For example, it has been found that when the support members are steel ropes used in tension the bending loads exerted on the wellhead by the riser system equipment can be reduced by at least 50%, e.g. between 50% to 75%.

The connection member(s) may be designed and/or arranged so that they are able to reduce the loads on the wellhead from the subsea riser system equipment such that material fatigue no longer needs to be a consideration during a typical lifetime of the subsea wellhead assembly.

The connection member(s) may be designed and arranged so that they are able to reduce the loads on the wellhead from the subsea riser system equipment sufficiently such that structural damage of the subsea wellhead assembly due to abnormally high single loads no longer needs to be a consideration.

For extreme accidental event scenarios, the total horizontal (lateral) force component from the riser, exerted to the top of the BOP, e.g. 10-15 m above wellhead datum, may be predicted to be in the range 500-800 kN.

The target may be that the maximum line tension (in each line) shall not exceed 350 kN in such cases. This means that the initial preload may be considerably less and typical line pretension may be in the range of 100-200 kN.

In other words, the connection members may be arranged to reduce the effects of both cyclic loads and high single loads.

The riser system equipment may extend vertically up from the wellhead away from the sea bed. The riser system equipment may be connected at its other end to a riser, the upper end of which may be connected to a surface facility such as a floating vessel.

The riser system equipment may be equipment which is attached to the wellhead that facilitates or improves the safety of operations such as drilling and completion in the well. The riser system equipment may for example be a blowout preventer and/or a Christmas/subsea tree. The terms Christmas tree and subsea tree may be used interchangeably.

For example, during drilling a blowout preventer may be provided directly on the wellhead and during completion a blowout preventer may be provided with a Christmas/subsea tree on the wellhead. Alternatively, the subsea riser system equipment may comprise a subsea tree without a BOP.

The present invention is particularly advantageous for supporting a BOP (as opposed to a Christmas tree only). This is because BOPs are typically much longer/higher (in a vertical direction) than a Christmas tree and thus the bending forces exerted by an unsupported BOP compared to an unsupported Christmas tree may be much greater. This is particularly the case when the BOP is installed on top of a subsea tree (i.e. the two riser system equipments are provided together) as in this case particularly high loads may be exerted on the wellhead from the subsea riser system equipment.

The riser system equipment may be a subsea stack. The subsea stack may sit on the wellhead. The template may be a structure which is positioned about the wellhead. The template may also be referred to as a protection frame or a protection envelope. The template for example may be a free-standing frame positionable over a wellhead and its associated components such as a tree. In this case the template may be anchored and mounted on its own dedicated anchoring points and foundations. The template may not be in contact with the wellhead. Alternatively the template may be connected or attached to the wellhead itself. The template may have a wellbay/well slot (e.g. a hole) for the well conductor, and thereby may support the wellhead. When installed, the top of the wellhead may be above the wellbay. When the subsea riser system equipment is mounted on the wellhead, it will not be in contact with the wellbay/well slot of the template.

The template may be an integrated template structure (ITS), i.e. template which integrates both a protection frame and a manifold.

The template may comprise guide posts (typically 4 posts in a square pattern). These guide posts may be used to guide the riser system equipment down onto the wellhead during installation. However, after installation, these guide posts do not, or are not intended to, laterally support the riser system equipment to prevent the effects of the bending moments from the riser system equipment. This is because guide posts are generally too laterally flexible to provide lateral support for reducing riser system induced load effects on the subsea wellhead.

The template may be overtrawlable. This means that the template may protect the wellhead and its associated components from damage that could be caused by trawlers operating near the wellhead.

By the template being associated with the wellhead, it may be meant that the template is fixed relative to the wellhead. For example, the template may be fixed to the seabed, for example via suction plates, suction piles or buckets or mud mats (depending on the material and properties of the surface being fixed to), so as to be fixed in a location relative to the location of the wellhead. The template may be located about the wellhead. The template may act as a protection device, such as a cage, to protect the wellhead from damage. The template may be connected to the wellhead and the template may support the wellhead. The template may be associated with a plurality of wellheads, for example, the template may be associated with four wellheads.

When the template is associated with a plurality of wellheads, any number (such as one, some or all) of the wellheads may be connected to respective subsea riser system equipment. When the assembly comprises riser system equipment connected to a number of different wellheads, each respective riser system equipment may be connected to the template via respective one or more connection (i.e. support) members.

The template may be a rigid structure/frame that is located about, i.e. around, the wellhead(s) on or extending from the sea floor.

The riser system equipment may be connected to the template by means of one or more connection members. The connection formed using the one or more connection members means that lateral support is provided to the subsea riser system equipment thus the connection member may be referred to as a support member. Thus the term support member and connection member are used interchangeably throughout the following description.

The assembly may comprise four (or more) connection members (i.e. support members), seven (or more) connection members or the assembly may consist of (i.e. only have) seven connection members. The assembly may comprise between 2 and 12, 5 and 10 or 6 and 8 connection members. This may be the number of connectors for the subsea riser system equipment on each wellhead.

The connection member may for example be a steel frame that is supported by the template and which supports the riser system equipment.

Each connection member may extend between the riser system equipment and the template. The connection member(s) may be or comprise an elongate member that extends between the riser system equipment and the template.

The connection member(s)/support members may each extend at an angle from the substantially horizontal plane of the template, and towards the riser system equipment.

The connection member(s) may extend at an angle between 0 and 90 degrees (i.e. be greater than 0 and less than 90 degrees), 10 and 80 degrees, 25 and 70 degrees, 40 and 50 degrees, or about 45 degrees, upwards from the horizontal plane of the template towards the riser system equipment.

The connection member(s) may be inclined (relative to the sea floor or the horizontal plane of the template), but it may not be vertical.

The connection member(s) may laterally support the riser system equipment and/or may reduce the loads or forces transferred to the wellhead from the riser system equipment compared to an assembly without any connection members.

The connection member(s) may be arranged so as to transmit forces between the riser system equipment and the template. The connection member(s) may be in tension or compression.

The connection member(s) (i.e. support member) may be a rod or bar which is in compression.

The connection member(s) may each be a steel beam such as a solid steel beam. The connection member(s) may be provided by a rigid frame which is between the template and the riser equipment.

The connection member(s) may be, or comprise, a line which is in tension. The line, for example, could be a wire, rope, cable, tether or chain etc. The line may be formed from a plurality of steel wire parts which are connected together to form a line.

The connection member(s) may rigidly connect the riser system equipment and the template.

The connection member may be made up of a number of parts such as a number of connected lines or other components.

The connection member may comprise a single component, such as a single line, which is connected to the subsea riser equipment and the template at a plurality of connection points.

At least one of the connection members may be connected at each end to the subsea riser equipment or at each end to the template and then at a mid-point (i.e. a non-end point) to the other of the subsea riser equipment or template.

Each connection member may provide a number of force transmission lines between the template and the subsea riser system equipment.

The connection members may each be connected to the template and/or the subsea riser system equipment. For example, one end of a connection member may be connected (directly or indirectly) to the template and the other, opposite end of the connection member may be connected (directly or indirectly) to the subsea riser system equipment. The connection member(s) may be directly connected to the subsea riser system equipment and/or the template or the connection member(s) may be indirectly connected to the subsea riser system equipment and/or the template such as via one or more connection parts such as a bracket or clamp which is attached directly to the riser system equipment or the template. In any event, even if not directly connected to the riser system equipment and/or template, the one or more support members may each extend directly between the riser system equipment and the template. The extension may be at an angle to the horizontal plane of the template and/or the central axis of the riser system equipment.

The support member(s) may transmit forces directly between the subsea riser system equipment and the template.

The riser system equipment may be connected to the wellhead, and then once connected to the wellhead, the subsea riser system equipment may be connected to the template by the one or more support members.

One end of a connection member may be connected (directly or indirectly) to the top frame of the template. The connection to the top frame may be at or near the corners of the top frame (if the top frame is square or rectangular). The other, opposite end of the connection member may be connected (directly or indirectly) to the outer frame of the subsea riser system equipment. This may be at the longitudinally extending corners of the subsea riser system equipment.

The connection member(s) may be connected to any part of the template, for example, the connection member may be connected to the bottom of the template.

The template and riser system equipment may have a nominal aft side (first side) that is opposed to a forward (fwd) side (second side) and a starboard (stb) side (third side) that is opposed to a port side (fourth side), wherein the port and starboard sides are substantially perpendicular to the aft and forward sides.

The assembly may comprise:

1) a connection member that extends from a position on the template that is forward and port, to a position on the riser system equipment that is aft and port, 2) a connection member that extends from a position on the template that is forward and port, to a position on the riser system equipment that is forward and port, 3) a connection member that extends from a position on the template that is forward and starboard, to a position on the riser system equipment that is forward and port, 4) a connection member that extends from a position on the template that is forward and starboard, to a position on the riser system equipment that is aft and starboard, 5) a connection member that extends from a position on the template that is aft and starboard, to a position on the riser system equipment that is aft and starboard, 6) a connection member that extends from a position on the template that is aft and starboard, to a position on the riser system equipment that is aft and port, and/or 7) a connection member that extends from a position on the template that is aft and port, to a position on the riser system equipment that is aft and port.

The riser system equipment may have one corner portion to which no connection members are attached. If the riser system equipment is off centre, i.e. towards one edge or corner, of the template, the corner portion of the riser system equipment that is closest the edge or a corner of the template may have no connection members attached thereto. Optionally, all of the other corner portions may have connection members attached thereto. If the riser system equipment is off centre, i.e. towards one edge or corner, of the template, the corner portion of the riser system equipment that is further from the edge or a corner of the template may have the most connection members attached thereto, e.g. three connection members.

If the riser system equipment is off centre, i.e. towards one edge or corner, of the template the corner portion of the template that is furthest from the edge or a corner of the riser system equipment may have the fewest connection members attached thereto. e.g. one or no connection members.

The attachments between the connection member(s) (and the connection parts if present) and the riser system equipment and/or template may be designed and located so that the resulting loads exerted on to the riser system equipment or template are within acceptable limits. For example, in relation to the connections between the connection members and the riser system equipment (such as a BOP) these should be carefully designed so as to not cause any damage to the riser system equipment during use. The riser system equipment may not have originally been designed to be used in the subsea wellhead assembly of the present invention (in which it is connected to the template) and as a result a detailed analysis is required to determine suitable attachment points and attachment means so as to not risk damaging the riser system equipment.

When the riser system equipment is a blowout preventer (BOP), the BOP may comprise a lower part (which may be referred to as a lower stack or a lower BOP stack) and an upper part (which may be referred to as a lower marine riser package (LMRP)). In this case, the one or more connection, i.e. support, members may each be connected to the lower stack. The assembly may be arranged so that the LMRP is not connected to the template. This is so that if required, the LMRP can be released and removed easily and quickly.

The connection members may be attached to the top of the BOP lower stack. The connection member(s) may be attached to the subsea riser system equipment about 5 to 10 m, for example about 7 m above the top of the wellhead (i.e. the wellhead datum).

The connection part that is for attaching the connection member(s) to the template may be a bracket. The bracket may be a balcony bracket, i.e. a bracket which is balcony shaped. The bracket may be shaped to be located on a portion of the template. The bracket may comprise a locking portion (e.g. a locking device or a locking function) to allow the bracket to be locked onto the structure. The bracket may be locked onto the structure by a locking device such as by a locking pin. The locking device may engage with the locking portion to lock the bracket to the structure.

The bracket may weigh less than 1000 kg. This is so that the bracket is unlikely to cause damage to the wellhead and its associated components in the event that it is dropped or some other accidental event occurs during installation of the bracket.

If the bracket weighs more than 1000 kg it may be necessary for more rigorous precautions to be taken with respect to minimising risk of damage to subsea equipment due to heavy dropped equipment.

The bracket may be arranged to be connected (directly or indirectly) to one or more connection members. For example, the bracket may be designed to be connected (directly or indirectly) to two connection members.

When the template has corners, for example when it comprises a top frame that forms a substantially square or rectangular shape (although the top-frame may not be continuous, i.e. it may not form the whole perimeter of the square or rectangular shape), a bracket may be located on one or more of the corners. For example, a bracket may be located on three corners of the top frame of the template. A bracket may be provided on some of the corners but not all of the corners. This is will depend on the number of connection members to be attached to the template at that location and whether the connection member can be directly connected to the template, for example in a pre-existing hole such as a vertical steel tube or a transponder bucket.

The bracket may envelop a corner of the template.

The bracket may be located so that it does not interfere with the operation of the template. For example, if the template comprises a cover, which may for example cover a wellhead when it is not in use, the bracket may be located so as to not prevent the opening and closing of the cover.

The support member(s) may each be connected at one end to a portion of the template, such as the top frame of the template. The other end of each support member(s) may be connected to an outer edge, surface or corner of part of the subsea riser equipment (e.g. an outer corner of a lower stack of a BOP).

The template may comprise one or more support arms. If present, the support arms may extend from one or more of the corners, e.g. of the top-frame, of the template. This support arm may extend at an angle between 0 and 90 degrees, 10 and 80 degrees, 40 and 50 degrees or about 45 degrees downwards from the plane of the top-frame towards the sea bed. The support arm may help support the bracket that is installed at the corner of the top-frame and/or may be used to help lock the bracket to the template. For example, the bracket may be shaped to be positioned over the corner (such that it covers a portion of two sides) of the top-frame and a portion of the support arm near the corner. This means that the bracket can be stably supported by the template.

The subsea wellhead assembly and/or the support member(s) may be arranged so that the amount of lateral support provided to the subsea riser system can be adjusted. For example, the amount of lateral support may be adjusted during use. The forces on the system, such as at the wellhead, in the support members themselves or in the template, may be monitored and the amount of lateral support may be adjusted accordingly.

The connection member(s) may each be provided with a tensioner, i.e. a vdevice that can act to cause a tension on the connection member to which it is attached. The tensioner may be used to put the connection member into tension so as to be able to transmit forces between the riser system equipment and the template. The tensioner may be used to provide a pretension on the connection member(s). This is so that the connection member(s) can be used to reduce (compared to an assembly without connection member(s)) the load which is transmitted to the wellhead from the riser system equipment.

Each connection member may comprise a tensioner and a force transmitting component such as a line which is to be put into tension by the tensioner.

The tensioner may be of a linear type, such as a chain jack, a chain hoist, or a screw jack tensioner (this may also be referred to as a mechanical rope tensioner). The tensioner may be designed to fit or grab onto the force transmitting component. This fit or grab may be achieved by a wire rope tension clamp onto smooth wire, a clamping device holding onto wire equipped with one or more "ferrules", or a "fork" device holding onto a rod with studs, etc. The tensioner may alternatively be of a rotating type, such as a winch or a windlass. The tensioner may be remotely controlled.

The tensioner may be ROV operable such as a tension clamp, a chain jack, a chain hoist or a screw jack tensioner. The tensioner may be a mechanical rope tensioner such as a winch or a windlass.

The tensioner may be controlled and/or powered by use of a mechanical, hydraulic or electric method. This may be using a ROV.

The tensioner may comprise a reversal preventing mechanism, such as a ratchet mechanism, that permits movement in one direction only.

The tensioner may have a number of modes of operation.

The tensioner may have a tensioning or active mode in which the tensioner can only allow movement in one direction e.g. act/move to tension, i.e. tighten, the connection member (e.g. when the reversal preventing mechanism is engaged), a locked mode in which the tensioner and reversal preventing mechanism cannot move, i.e. in which it prevents both tightening and slackening, and a slackening or disabled mode in which the tensioner can move in both directions to permit tensioning and slackening of the connection member. e.g. when the reversal preventing mechanism is disengaged.

When the reversal preventing mechanism is engaged, the connection member can be tensioned, but it cannot be slackened by intention or accidentally. For slacking the connection member, the tensioner has to be in the slackening mode, e.g. an ROV has to disable the reversal preventing mechanism.

The connection member(s) may be attached to the reversal preventing mechanism. For example, the end of the connection member may comprise an engagement device, e.g. a pull-in head, for engagement with the reversal preventing mechanism of the tensioner.

The tensioner may have an extended position and a retracted position and may be movable between the two positions. The distance between the fully extended and the fully retracted position may be termed the stroke length. The tensioner may have a stroke length of 200 to 1000 mm, 400 to 800 mm, 550 to 650 mm or about 600 mm. The desired stroke length will depend on a number of factors such as the size of the assembly and the pretension that is to be applied to the connection members.

During installation, the connection member may be initially connected to the tensioner when it is in the fully (or nearly fully) extended position or at least partially extended position and then the tensioner may be retracted until the desired pretension is exerted on the connection member.

The tensioner may be located between the template and the respective connection member. The tensioner may be located between the subsea riser equipment and the respective connection member (i.e. the force transmitting component such as the line of the connection member).

The tensioner may be provided at any position along the length of the connection member such as mid-line.

The tensioner may be installed on the subsea riser system equipment (e.g. a BOP). This installation may be before the subsea riser system equipment is subsea, i.e. the tensioner may be preinstalled on the subsea riser equipment. Alternatively, the tensioner may be installed on the subsea riser system equipment after it is located subsea and/or associated with the wellhead.

The tensioner may be installed temporarily or permanently.

The tensioner may therefore be used to provide pretension and to act as a support and connection means for its respective connection member. For example, the tensioner may be attached to the template and the connection member may be attached to a part (such as the reversal preventing device) of the tensioner.

A portion of the tensioner, i.e. a connection portion such as a guide bolt, may be directly attached to or received directly in the template, such as in a hole in the frame of the template. The hole may be a pre-existing hole in the frame that was used for another purpose such as for holding the frame during installation and/or for subsea navigation equipment (e.g. acoustic transponders). The hole may be at, near or towards the corners of the template. The hole may be a transponder bucket.

A portion of the tensioner, i.e. a connection portion such as a guide bolt, may be directly attached to or received in a connection part, such as the above discussed bracket that may be mounted onto the template. The bracket may be arranged (e.g. it may have two or more holes) to permit the attachment of two or more tensioners.

In an assembly that comprises a plurality of connection members and a plurality of tensioners, some tensioners may be attached (e.g. received) directly in the template (i.e. in the frame of the template) and some tensioners may be attached to (e.g. received in) a connection part, such as a tensioner support such as the above described bracket, that is mounted on the template or a lifting pad eye connected to the template.

The tensioners may be locked to the template or connection part by a locking device, such as a locking pin. The locking device may pass through an aperture in the tensioner and the template or connection part to lock the two parts together. This is so that the tensioners can be prevented from being lifted off the template or connection part or moved during use.

The tensioner may be arranged so that it can be set up and operated using a remotely operated vehicle (ROV), e.g. a ROV manipulator. This means that the assembly can be installed and set up subsea and at any water depth without difficulty.

For example, during installation a deployment wire from the vessel may take the weight of the tensioner and lower it to near the installation site and then an ROV may be used to guide the tensioner into its precise installation position and set it up.

The tensioner may comprise a connection portion, such as a guide bolt, and a main body that is arranged to receive a portion of the connection member. The main body may comprise the reversal preventing mechanism, e.g. ratchet mechanism.

The main body may comprise a guiding member, such as a guide funnel, that may be located at the end of the main body opposite to the connection portion.

The main body may be movable between the extended position and the retracted position, i.e. the main body may comprise parts that are movable, e.g. slidable, relative to each other.

The connection portion and main body of the tensioner may be movable relative to each other. For example, the connection portion and main body may be rotatable relative to each other about an axis that is substantially parallel to an axis of the connection portion and/or about an axis that is substantially perpendicular to the axis of the connection portion. For example, the main body may be rotatable by at least 180 degrees, preferably 360 degrees, relative to the connection portion about an axis that is parallel (i.e. substantially parallel) to the axis of the connection portion and/or it may be rotatable/pivotable by at least 180 degrees about an axis that is perpendicular (i.e. substantially perpendicular) to the axis of the connection portion. These degrees of freedom in the relative movement between the main body and the connection portion can facilitate the installation of the tensioner, e.g. the pull-in and connection of the connection member (e.g. steel rope) into the tensioner.

Each tensioner may be provided with an installation guide line (which may be referred to as a pilot line). The installation guide line may be referred to as a fore-runner. The installation guide line may be a line with a link or hook at one end for connection to a connection member and a link or hook at the other for connection to an installation device, such as a ROV. The installation guide line may be installed in the tensioner before it is deployed subsea. The installation guide line may be used to install the connection member on the tensioner. The link or hook at one end for connection to a connection member may be connected to a connection member. This connection may occur subsea. Once the installation guide line is connected to the connection member, an installation device, such as a ROV, may be used to pull the installation guide line so as to cause the connection member to engage with the tensioner, such as the reversal preventing device of the tensioner, so that it can be pre-tensioned.

Each connection member may have a rated (permissible) tension of up to or over 700 kN, 200-600 kN, 400 to 500 kN or 300 to 400 kN, such as about 350 kN. The desired rated tension of the connection member will depend on a number of factors, such as the size and weight of the parts of the assembly, the environment it is being used in and the likely forces that will act on the assembly.

A force sensor (e.g. tension sensor when the connection members are in tension), such as a load cell, may be provided on each connection member. The force sensor may be a pneumatic line tension sensor or an electronic load cell for example.

The force sensor may be arranged so that it can provide force readings during operation. For example, it may display the force so that it can be read by an ROV camera subsea. Alternatively, the force sensor may be arranged to provide an indication of the force at a location topside, e.g. using a signal cable.

When installing the wellhead assembly, connection parts, e.g. clamps, may be mounted on the riser system equipment before it is deployed subsea, i.e. when the riser system equipment is topside. The connection parts, e.g. clamps, may be attached, such as bolted, onto the wellhead equipment. These connection parts may permit the connection member(s) to be connected to the riser system equipment, i.e. the connection member may be connected directly to a connection part that is mounted on the riser system equipment. For example, the connection part may have an engagement portion such as a protrusion, hook or loop to which a connection member can be attached. The connection part may have a plurality of engagement portions so that a plurality of connection members can be attached to a single connection part.

If the riser system equipment, such as a blowout preventer, has a substantially square or rectangular cross sectional shape, the connection parts may be mounted onto the longitudinally extending corners (i.e. corners that are substantially vertical in use) of the riser system equipment. A connection part may be provided on each of these corners of the riser system equipment.

After the connection parts have been mounted on the riser system equipment, the riser system equipment may be deployed subsea and connected to the wellhead in a known manner.

After the riser system equipment is connected to the wellhead, the riser system equipment may be connected to the template, such as by the above described connection member(s). These connection members may have one or more of the optional features discussed above, for example, they may be a line, they may be provided with a force sensor and/or they may be connected to the template via a tensioner that is arranged to be able to pretension the connection member.

The installation method may comprise installing one or more connection parts, such as the above described brackets, onto the template and locking the connection parts in position on the template. The connection parts may be installed onto the template when it is subsea. This may be either before or after the riser system equipment has been connected to the wellhead.

After the riser system equipment has been connected to the wellhead, tensioners may be installed. A tensioner may be installed for each connection member in the assembly.

If there is a plurality of tensioners some tensioners may be connected directly to the template and some tensioners may be connected to a connection part, such as a bracket, installed on the template.

To install the tensioner it may be deployed subsea and then the connection portion of the tensioner may be attached to the template or a connection part, e.g. it may be received in a hole in the template or a hole in a connection part. The tensioner may then be locked in place by a locking device, such as a locking pin.

Two tensioners may be attached to one connection part.

Once installed, the main body of the tensioner may extend in a direction towards the riser system equipment.

The connection member(s) may then be installed. If the connection member is to be provided with a load cell, this may be connected to the connection member before it is connected between the template and the riser system equipment. This may be before the connection member is deployed subsea.

To connect the connection member between the riser system equipment and the template, one end of the connection member may be connected to the riser system equipment. This may be indirectly via a connection part, such as clamp, that is installed on the wellhead assembly such as on the riser system equipment. For example, the end of the connection member may have an engagement portion, such as a loop, that can engage with an engagement portion of the clamp, such as a protrusion, loop or hook. The other end of the connection member may be connected to the template. This connection may be via a tensioner.

The end of the connection member may be connected to an installation guide line that has been preinstalled in the tensioner. A tension, for example 10-40 kN, may be applied to the installation guide line after it has been attached to the connection member so as to cause the connection member to engage with the tensioner. When the tensioner comprises a reversal preventing device the force applied to the installation guide line may cause the end of the connection member to engage with the reversal preventing device, for example this may be a one-way saw tooth interface of a ratchet mechanism.

The installation of the connection members may comprise two steps a) pull in of the connection member into the tensioner by use of the installation guide line, e.g. to around 10 kN, which may make the assembly reasonably straight, and b) tensioning the connection member, e.g. by use of ROV torque tool to operate the tensioner, to increase the tension from, for example, 10 kN to about 200 kN. The force may vary depending on a number of factors such as the size of the assembly or the forces that are expected during operation.

If there is a plurality of connection members, the connection procedure may be repeated for each connection member.

Once the connection members are installed they may be pretensioned using the tensioner. This may be achieved by retracting the tensioner towards its retracted position. The tensioner may be arranged so that it can be operated by an ROV. For example, it may be arranged so that an ROV can adjust the tensioner by retracting or extending the position of the tensioner. The tensioner may be operated by an ROV torque tool and this may be via a pressure compensated angle gear box.

When or as the pretension is applied lateral support may be provided to the subsea riser system equipment. At the same time a vertical downward force may be applied to the subsea riser system equipment. This vertical downward force may put the subsea riser system equipment into compression on the wellhead.

The pretension may be applied so that all of the lateral forces (i.e. those with a horizontal component) are zeroed out by the connection members. However, the downward force may be not zeroed out by the connection members and thus the subsea riser system equipment may be put into compression.

After pretension has been applied to the assembly, it can provide support to the subsea riser system equipment and relieve the subsea wellhead from part of the bending moment caused for example by a drilling operation and/or vessel motions and/or wave and current forces on the riser.

If there is a plurality of connection members, each connection member may have a different pretension.

If present, the load cell may be used to monitor the tension applied to its respective connection member.

The pretension may be applied to the connection members gradually, e.g. all the connection members may be partially pre-tensioned (relative to the final intended pretension), such as to 50% of the final pretension and then 75% of the final pretension, before increasing the pretension in all of the lines to 100% of the final pretension. This is so that the forces from the connection members to the riser system equipment can be applied gradually from the connection members to avoid having too large a net tension force on the riser system equipment.

After all of the connection members have been pretensioned, inspection and verification of the pretension may be performed regularly, e.g. about every three hours, until it appears that the system has stabilised.

The components may be deployed subsea using a heave compensated lifting line and/or an ROV. For example, the heave compensated lifting line may be used to lower the components to near the subsea assembly and then an ROV may be used to guide the components into their final position.

Certain components, such as the bracket, tensioners and other equipment of the assembly may be attached to buoyancy elements during installation to reduce their submerged weight. This is to help reduce the likelihood of damage in the event that the component is dropped during installation.

At least some of the components of the assembly may be transported to the location top-side from where they are deployed subsea in transportation/handling baskets that may be stored in a container.

Preferably each connection member is designed, for example with regard to strength and stiffness, to keep the tension within its rated value even when subjected to a worst case accidental load.

Preferably the assembly is designed so that it has a subsea design life of a minimum of 6 months continuous operation. The life can be increased by means of a maintenance program.

In another aspect the present invention provides a subsea wellhead assembly, the assembly comprising: a subsea wellhead; a template associated with the wellhead; subsea riser system equipment connected to the wellhead; and a connection member connected between the subsea riser system equipment and the template The connection member may provide lateral support to the subsea riser system equipment.

In a preferred embodiment the subsea wellhead assembly, comprises: a subsea wellhead; a template located about, and optionally connected to, the wellhead; a blowout preventer connected to the wellhead; and a plurality of lines, or other connection members, extending between the subsea riser system equipment and the template so that lateral support is provided to the subsea riser system equipment via the lines or connection members.

The present invention may provide a method of installing a subsea wellhead assembly of any of the above described aspects.

The method of installing a subsea assembly may have any of the features, including the optional or preferable features, of any of the above described aspects.

One or more of the features, including the optional or preferable features, of any of the above described aspects are applicable to any of the other above described aspects of the invention.

Certain preferred embodiments of the present invention will now be described by way of example only with reference to the accompanying drawings, in which.

Figure 1:
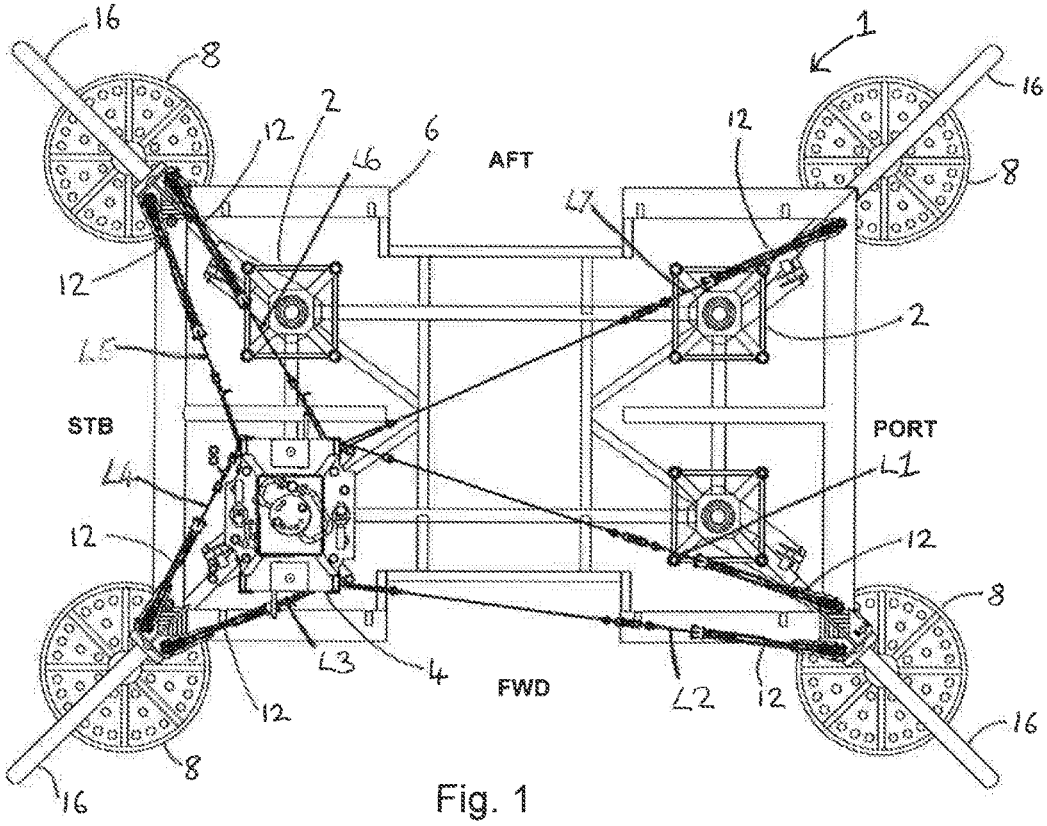
FIG. 1 shows a plan view of a subsea wellhead assembly.
Figure 2:
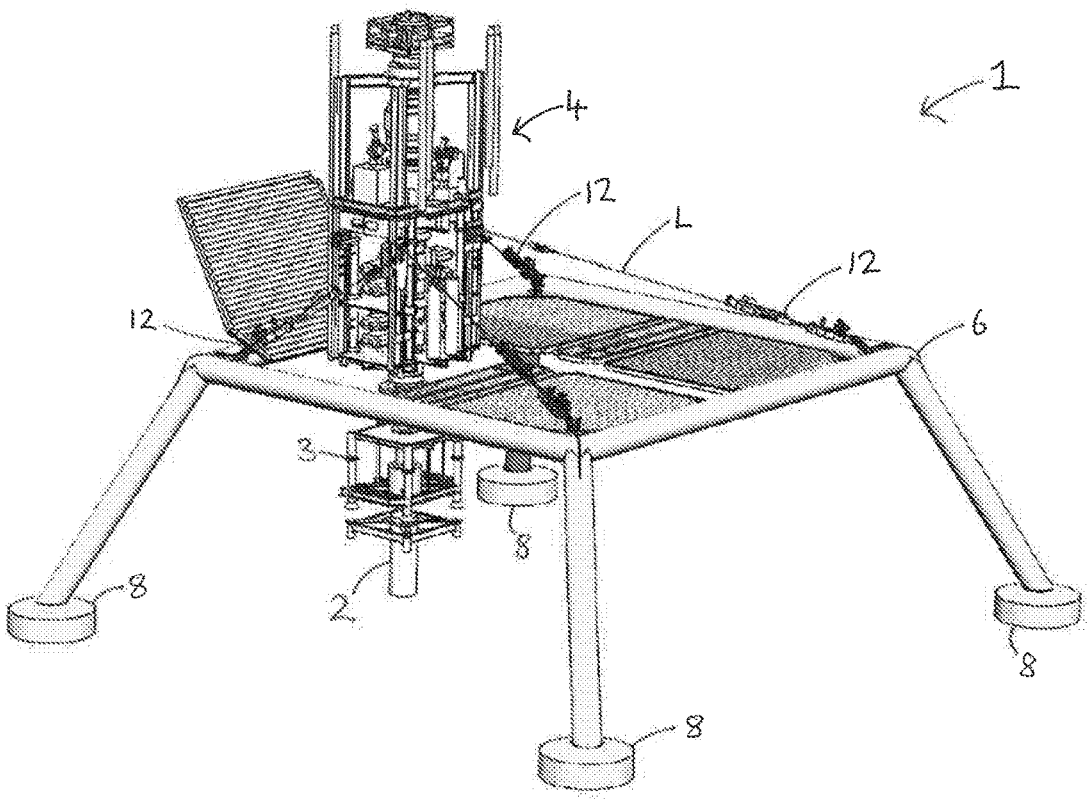
FIG. 2 shows a perspective view of another subsea wellhead assembly.

A subsea wellhead assembly 1 is shown in FIG. 1 and another subsea wellhead assembly 1 is shown in FIG. 2. The subsea wellhead assembly 1 comprises a wellhead 2. As illustrated by FIG. 1 the assembly may comprise a plurality of wellheads 2, in this case four.

Subsea riser system equipment, in this case a blowout preventer (BOP) 4, is attached to the wellhead 2. The attachment between the BOP 4 and the wellhead 2 may be via a Christmas/subsea tree 3. A subsea template 6 is associated with the wellhead 2 to which the BOP 4 is attached. The template 6 will be fixed to the sea bed by means of suction plates 8. This means that the template 6 will be fixed relative to the wellhead 2. The template 6 may be connected to, and support the wellhead 2.

Figure 8:
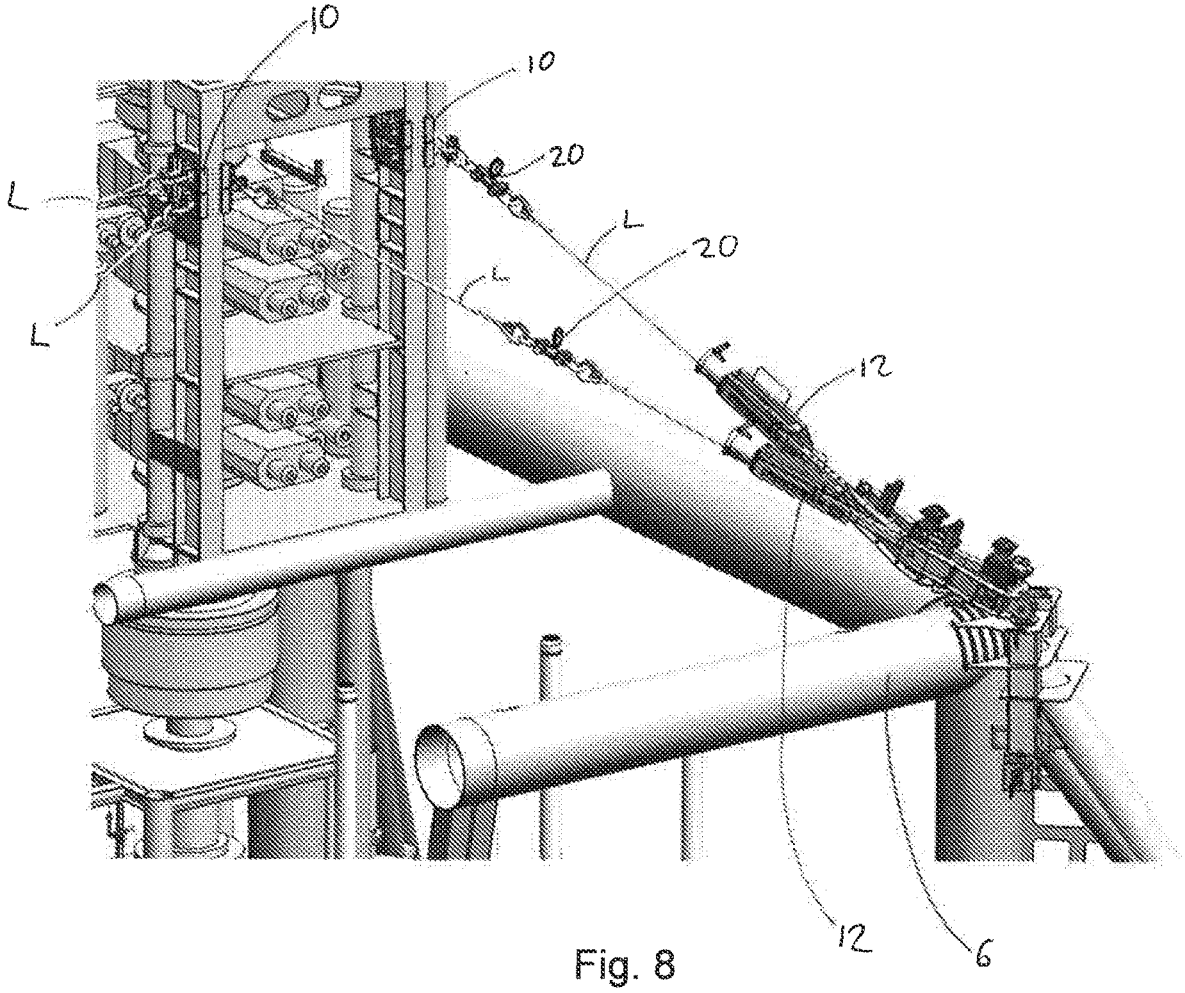
FIG. 8 shows a part of a subsea wellhead assembly including a clamp on the riser system equipment.
Figure 12:
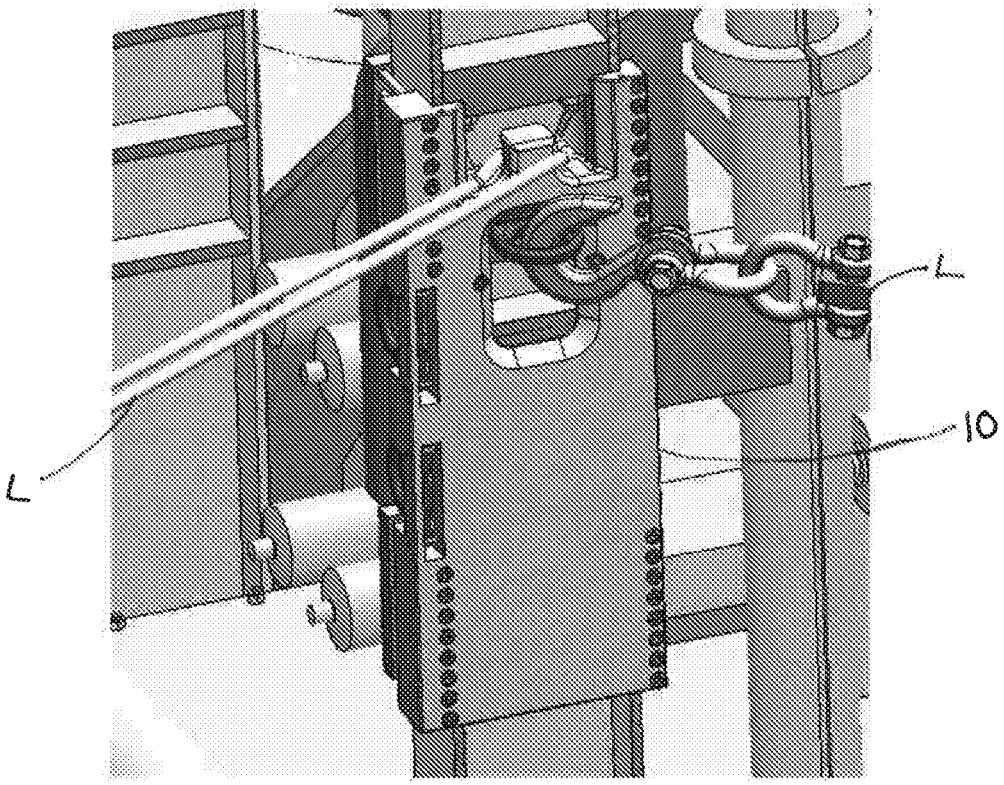
FIG. 12 shows a clamp on the wellhead assembly.

The BOP 4 is connected to the template 6 by tension lines L. In the wellhead assembly 1 of FIG. 2 there are four tension lines L and in the wellhead assembly 1 of FIG. 1 there are seven tension lines L that are labelled L1 to L7. The tension lines L are formed from links of steel wire. The tension lines L are each connected at one end to the BOP 4 via a clamp 10 (as shown in FIG. 8 and FIG. 12 for example).

The clamps 10 are bolted onto a part of the frame of the BOP 4. The clamps 10 each have a number of protrusions to which an end connection portion of the tension line L can connect.

The tension lines L are each connected at the other end to a tensioner 12. The tensioners 12 are each connected to the template 6. Some of the tensioners 12 are received directly in a hole (that may be referred to as a transponder bucket) near a corner of the template 6 and other tensioners 12 are received in a tensioner support/bracket 14 that is mounted on the template 6.

Figure 3:
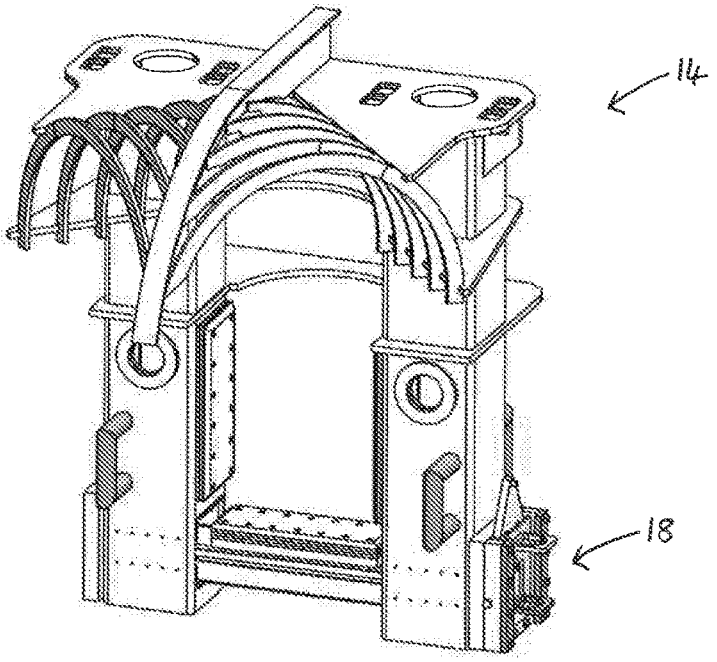
FIG. 3 shows a tensioner support.
Figure 4:
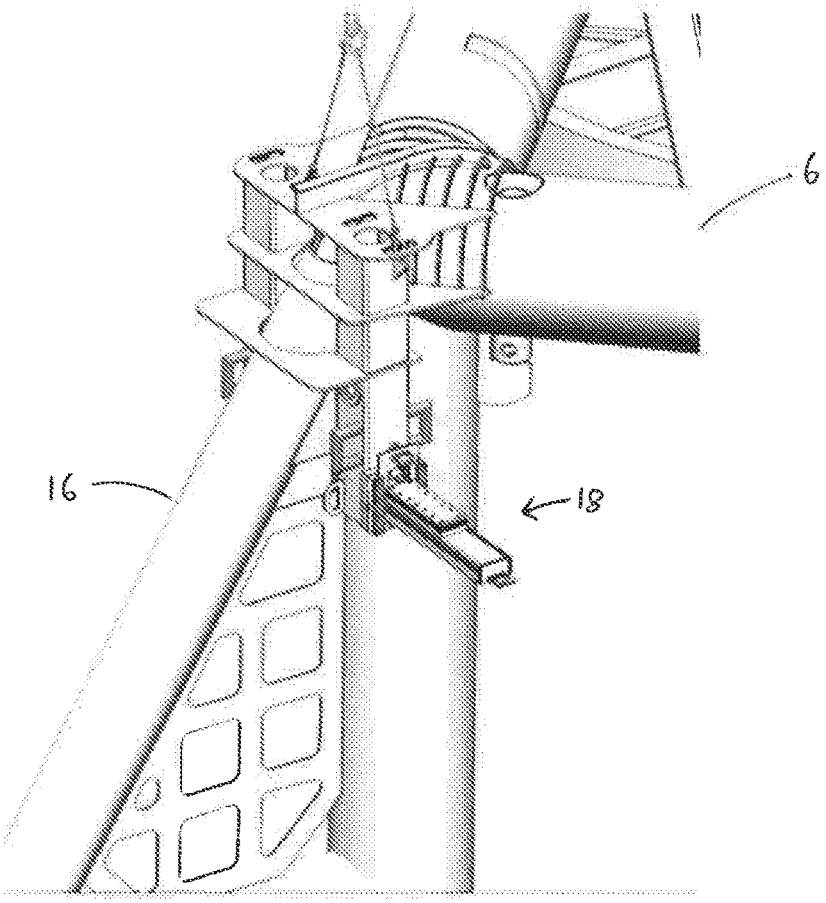
FIG. 4 shows the tensioner support being installed on a template.

As shown in FIGS. 3 and 4 for example, the tensioner supports (also referred to as a bracket) 14 are shaped to fit onto a corner portion of the template 6. As shown in FIG. 1, the template 6 may comprise support arms 16 at each corner of the template 6. These support arms 16 each extend at about 45 degrees downwards from the plane of the top of the template 6 towards the seabed. These support arms 16 together with the top frame of the template 6 can be used to support the bracket 14.

The bracket 14 may be locked in position on the template 6 by means of a locking device 18. The locking device 18 may extend through a gap located between a support arm 16 of the template 6 and a leg that extends between the top frame and a suction plate 8 on the sea bed. The locking device 18 may act to lock the bracket 16 to the template 6.

The brackets 14 each have a hole to permit a tensioner 12 to be connected to the bracket 14. As shown for example in FIGS. 1 and 8, a bracket may be able to be connected to two tensioners 12.

The wellhead assembly 1 may not comprise any brackets 14 as shown in FIG. 2 and the tensioners 12 may be connected directly to the template 6.

Each tension line L may have a load cell 20 thereon. This permits the tension in each line L to be measured during installation and operation of the subsea wellhead assembly 1.

Figure 5:
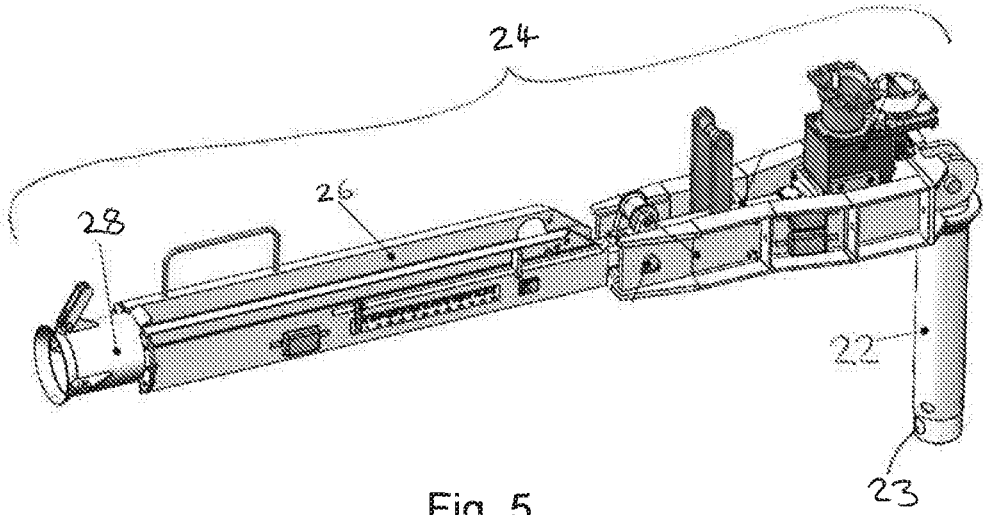
FIG. 5 shows a tensioner.
Figure 6:
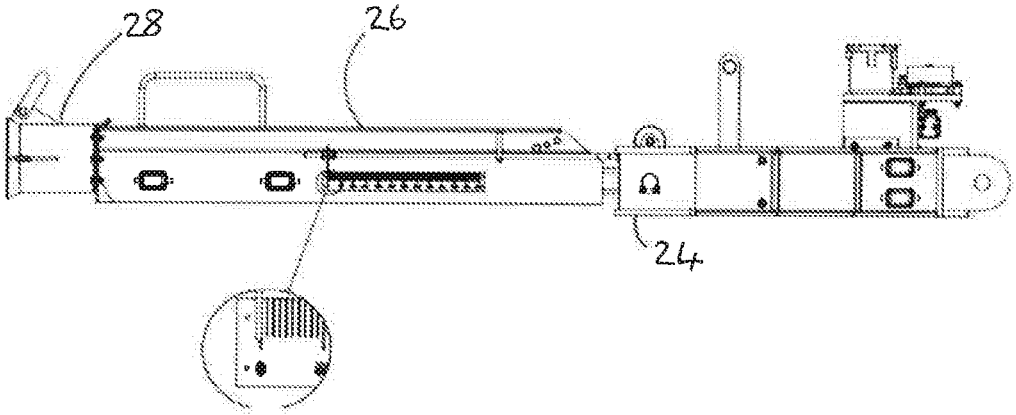
FIG. 6 shows a side view of the tensioner in a fully retracted position.
Figure 7:
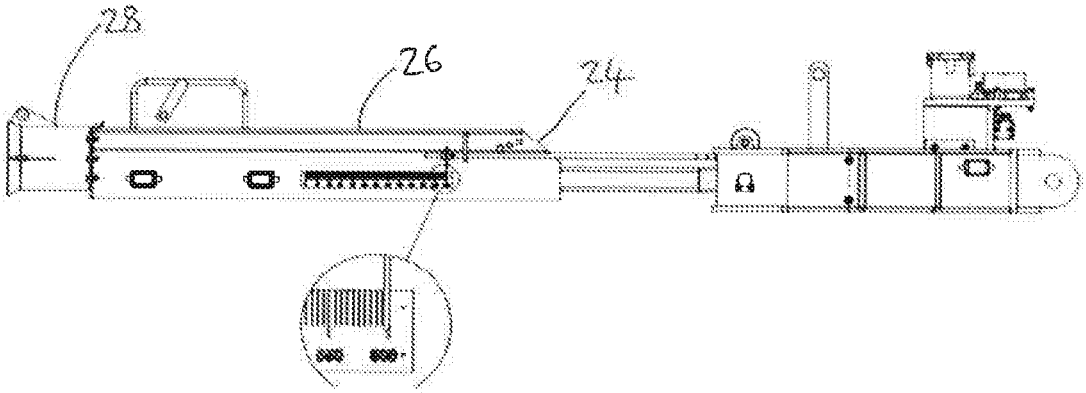
FIG. 7 shows a side view of the tensioner in a fully extended position.

The tensioners 12 may each be a mechanical rope tensioner as shown in FIGS. 5, 6 and 7.

The tensioners 12 in a wellhead assembly 1 may be of different lengths. For example, some tensioners 12 may be longer tensioners whilst some tensioners 12 may be shorter tensioners (with reference to the other tensioners 12 in the assembly 1).

The tensioner 12 comprises a connection portion in the form of a guide bolt 22 (not shown in FIGS. 6 and 7) and a main body portion 24. The main body 24 may rotate by 360 degrees about the axis of the guide bolt 22 and may pivot relative to the guide bolt to permit the main body 24 to extend at a desired angle to the template 6 once it is installed.

The guide bolt 22 may be received in the template 6 or in a bracket 14 as discussed above. The tensioner 12 may then be locked in position by a locking pin (not shown) that passes through a hole 23 in the bottom of the guide pin 22.

The tensioner 12 has a ratchet mechanism 26. The tension line L may have an engagement portion 27 at one end that can engage with the ratchet 26 of the tensioner 12 to thereby connect the tension line L to the tensioner 12.

The ratchet 26 can act to accommodate slack that may occur in the tension line L during operation of the subsea wellhead assembly 1.

The tensioner has a guide funnel 28 through which the end portion of the tension line L that engages with the ratchet 26 can be received and guided.

The tensioner 12 is movable between a retracted position as shown in FIG. 6 and an extended position as shown in FIG. 7. This may be achieved using an ROV when then tensioner 12 is subsea.

Figure 13:
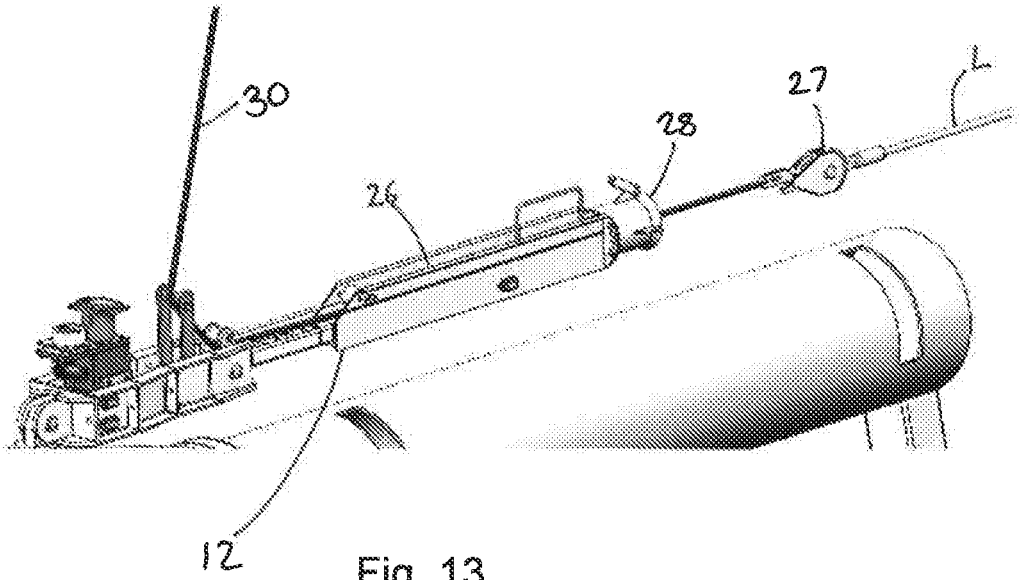
FIG. 13 shows a tension line being pulled onto a tensioner using an installation guide line.

The tension line L may be attached to the tensioner 12 when it is in the extended position or a partly extended position (as shown in FIG. 13). The tensioner may then be moved to a more retracted position so as to put a pretension on the tension line L.

The template and riser system equipment may have a nominal aft side that is opposed to a forward (fwd) side and a starboard (stb) side that is opposed to a port side, wherein the port and starboard sides are substantially perpendicular to the aft and forward sides.

For the embodiment shown in FIG. 1 the below table lists for each of the seven tension lines L, where it is connected to the template, where it is connected to the BOP 4, whether the tensioner 12 is connected directly to the template (via a transponder bucket) or the tensioner support 14, what the tension line L is formed from and whether the tensioner is a longer or a shorter (relative to the other tensioners) tensioner 12.

| Line no | Template connection location | BOP connection location | Tensioner installation | Description | Length of tensioner |
|---|---|---|---|---|---|
| L1 | Fwd Port | Aft Port | Transponder bucket | 2 parts steel wire | Long |
| L2 | Fwd Port | Fwd Port | Tensioner support | 2 parts steel wire | Long |
| L3 | Fwd Stb | Fwd Port | Tensioner support | Grommet | Short |
| L4 | Fwd Stb | Aft Stb | Tensioner support | 1 part steel wire | Short |
| L5 | Aft Stb | Aft Stb | Tensioner support | 1 part steel I wire | Long |
| L6 | Aft Stb | Aft Port | Tensioner support | 1 part steel wire | Long |
| L7 | Aft Port | Aft Port | Transponder bucket | 2 parts steel wire | Long |

Figure 9:
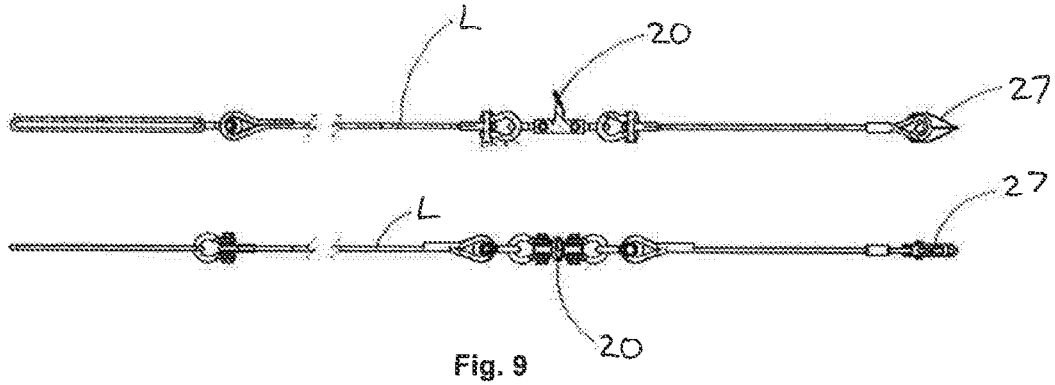
FIGS. 9, 10 and 11 show example tension lines.
Figure 10:
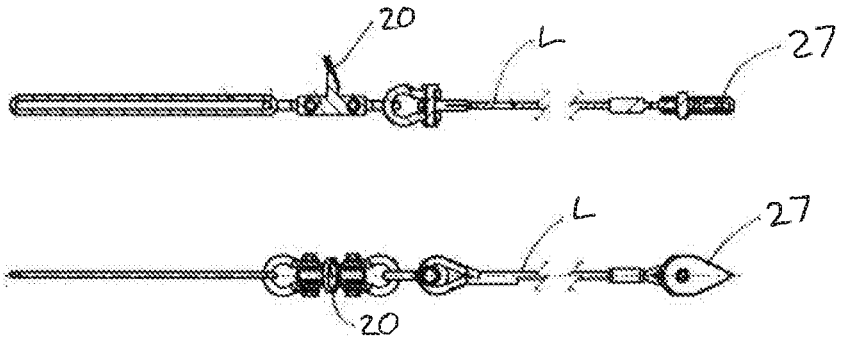
Figure 11:
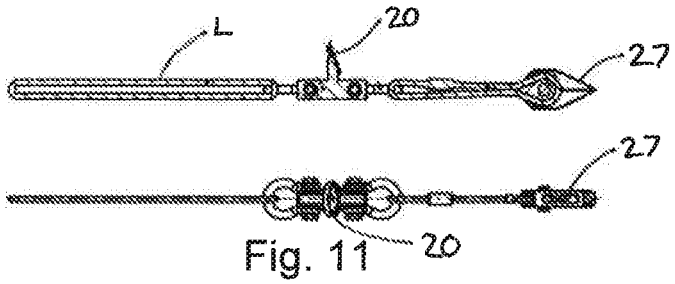

FIG. 9 shows a tension line L formed from 2 parts steel wire, FIG. 10 shows a tension line L formed from 1 part steel wire and FIG. 11 shows a tension line L formed from a grommet.

The installation of the subsea wellhead assembly 1 will now be discussed. The BOP clamps 10 are installed while the BOP 4 is on a deck, prior to subsea activities. The remaining equipment, which is part of the assembly 1, shall be installed subsea. The tensioners 12 may be installed on the template 6 prior to installing the BOP 4, but the hook-up of the tension lines L etc. will be performed after the BOP 4 has been installed on the wellhead 2.

Figure 14:
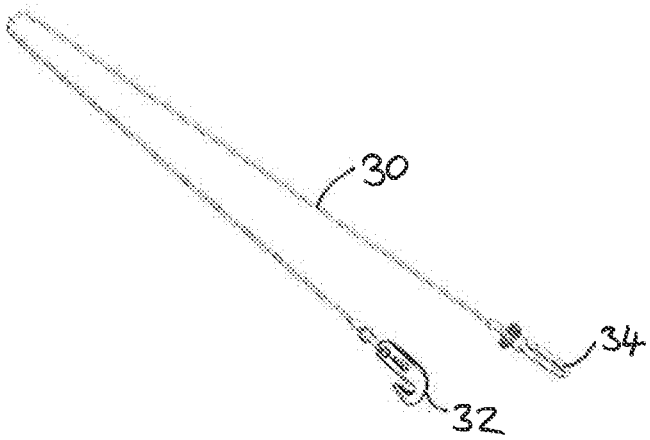
FIG. 14 shows an installation guide line.

The installation of the subsea wellhead assembly 1 may have the following main steps:

Preparing equipment for installation
Performing pre-installation survey
Installing BOP Clamps 10 topside
Installing tensioner supports 14
Installing and locking tensioners 12
Preparing tensioners 12 for connection to tension lines L
Hooking-up of tension lines L with pull-in head
Pretensioning the lines L with the tensioners 12
Performing a post-installation survey Firstly the equipment is prepared for installation. The tensioners 12 may each be pre-installed with an installation guide line 30 (shown in FIGS. 13 and 14) or fore-runner that is used to aid the operation of connecting the tension line L to the tensioner 12. The installation guide line 30 is a line with a link or a hook 32 at one end for connection to a tension line L and a link or hook 34 at the other for connection to an ROV. The installation guide line 30 may be fed through the tensioner 12 topside and then used subsea to pull the tension line L into connection with the ratchet 26 of the tensioner 12.

The tension line L may each be connected to a load cell 20 topside.

Next the subsea steps are explained. An ROV is used to verify that the transponder buckets in the template 6 are clean and free from debris. The transponder buckets may then be cleaned if required.

The tensioner supports 14 may then be installed. This can be achieved by lifting the tensioner support 14 from a cellar deck using a heave compensated lifting line and then lowering the tensioner support 14 to a location, for example 15m, above the template 6. The tensioner support can then be guided by an ROV, which grabs the lifting line, to the intended installation position on the template 6. The ROV may then be used to lock the tensioner support 14 to the template 6. This may be achieved by pushing the locking mechanism 18 into the tensioner support and through a portion of the template 6.

The lift wire may then be retrieved so the above steps can be repeated for each tensioner support 14 to be installed.

Next the tensioners 12 are installed. The tensioners 12 may be lifted off the basket and deployed from the cellar deck using a heave compensated lifting line. The tensioner is lowered to a location, for example to 15 m, above the template 6. The tensioner 12 may be installed in the transponder bucket in the template 6 or in a hole on one of the installed tensioner supports 14.

An ROV may be used to grab the tensioner, pull and guide it to the transponder bucket or a hole in the tensioner support 14.

The ROV may be used to align the hole in the guide bolt 22 to a hole in the bottom of the transponder bucket or tensioner support 14.

The ROV may then be used to install a locking pin through a hole in the transponder bucket or tensioner support 14 and the hole 23 in the guide pin 22 so as to lock the tensioner 12 in position. This may then be repeated for each tensioner 12. A tensioner 12 is provided for each tension line L.

Each tensioner 12 may then be set into its extended position by the ROV.

Next the tension lines L, which each have a pull-in head 27, are deployed from the cellar deck by using a heave compensated lifting line.

The tension line L is lowered to a location, for example 15 m, above the template 6. Using an ROV one end of the tension line L is hooked onto one of the BOP clamps 10. The ROV may then be used to guide the other end of the tension line L with pull-in head 27 to the tensioner 12. The pull-in head is connected to one end of the pre-installed installation guide line 30 in the tensioner 12 (as shown in FIG. 13).

The ROV may then be used to apply a tension of 10-40 kN to the installation guide line 30 so as to pull the pull-in head 27 into the saw tooth interface of the ratchet mechanism 26 on the tensioner 12.

This process can then be repeated for each tension line L.

The lines L may then be pretensioned by moving each of the tensioners 12 towards its retracted position until the desired tension is achieved.

In a preferred embodiment the lines shall be given a pretension as follows:

Line L1=120 kN (12 ton)
Line L2=100 kN (10 ton)
Line L3=200 kN (20 ton)
Line L4=210 kN (21 ton)
Line L5=100 kN (10 ton)
Line L6=200 kN (20 ton)
Line L7=120 kN (12 ton)

As used herein the term "ton" refers to a metric tonne, i.e. 1000 kg. When used as a force measure, it may mean the force equivalent to the weight of 1000 kg mass, i.e. the force=1 ton×9.81 $m/s^2$=9810 N.

The process of tensioning the lines L may be as follows. The method may include locating an observation ROV in place to observe the load cell 20 of the line L that is being tensioned.

The method may then include tightening all of the tension lines L with a low torque equaling less than 10 kN. Following this all the tension lines L may in turn be tightened to 50% of the final desired pretension.

The tension lines L may then again in turn be tightened to 75% of the final pretension. Finally, the tension lines L may then again in turn be tightened to 100% of the final pretension.

During this procedure the output of the load cell 20 on each line can be observed after each gradual increase in the pretension using the observation ROV.

Inspection and verification of the presentation in the lines L may be performed every 3 hours after the installation is complete.

Once it is observed that the system 1 has stabilised, the inspection intervals can be extended to longer periods, such as 6 hours and then 12 hours until the system appears to be entirely stable.

Depending on the readings taken by the observation ROV, e.g. an ROV camera, the tension in the tension lines L may be adjusted using the tensioners 12 to obtain the desired pretension. For example, a tensioner 12 may be adjusted if the average tension is more than 20 kN (2 tons) below the desired tension. It should be noted that if the tension is more than 50 kN (5 tons) from the desired tension a corrective action may be required to rectify the incorrect tension.

If some lines L have too low tension and some too high tension (e.g. variations due to lower riser inclination), then it may not be necessary to adjust the tension in the tension lines L. This for example may occur due to load variations on the riser e.g. natural loads from ocean current variations, and thus may not require adjusting of the tensioners to correct this.

If it is desired to uninstall the assembly, e.g. when the BOP 4 is to be detached from the wellhead 2, the following procedure may be followed.

- Pre survey of the attachments of the tension lines L to the BOP 4 and tensioner 12.
- The observation ROV may be used if needed.
- Torque tool (TT) mounted on ROV and calibrated.
- Hard line cutter mounted on ROV if contingency cutting is required.
- Cellar deck ready to assist with lifting line.
- Position the ROV at the first tension line L to be unhooked. Relieve the pretension on the tension lines L by moving the tensioner 12 towards its extended position. This should be repeated for each of the tension lines L.

Once it is observed that the tension line L is slack, the ROV may be used to unhook the tension line L from the tensioner 12. This may be achieved by connecting an ROV hook to the pull-in head 27 and then lifting a thimble of the pull-in head 27 clear of the ratchet mechanism 26 on the tensioner 12 for the tension line L.

Once disconnected from the tension line L the tensioner may be laid down on the roof of the template 6.

The other end of the tension line L may then be unhooked from the clamp 10 mounted on the BOP 4. The disconnected tension line L may then be lifted to the surface.

This process may then be repeated for each of the tension lines L.

The tensioners 12 may then each be retracted using an ROV. Following this the tensioners can each be lifted to the surface.

The method may then comprise retrieving the locking pin that locks down the tensioner 12 to the template 6 from the drilled hole in the bottom of the transponder bucket or the tensioner support 14. This may be followed by attaching the surface lift line to the tensioner to permit the tensioner 12 to be lifted vertically and then lifting the tensioner 12 out of the transponder bucket or tensioner support. The ROV may be used to assist the lift operation and guide the tensioner 12 out of the transponder bucket or tensioner support 14.

The tensioner 12 can then be lifted to the surface, the retrieved tensioner may be placed in the basket for transport to shore. This process may be repeated for each of the tensioners 12.

To retrieve the tensioner supports 14, the surface lift line may be attached to the tensioner support 14, the ROV can be used to release the tensioner support 14 by pulling out the locking mechanism 18. The ROV may be used to lock the locking mechanism 18 in an open position with a locking wedge. The ROV may be used to grab the lift wire and guide the tensioner support away from the template 6.

The lift wire may then be used to lift the tensioner support 14 to the surface. This can then be repeated for each of the tensioner supports 14.

If desired, the BOP 4 can then be retrieved.

In the case that the tension lines L cannot be slackened by extending the tensioner 12 the following contingency procedure may be followed.

A hard line cutter may be used to cut the tension line L, this may be achieved by cutting the connection portion used to connect the tension line to the clamp 10 of the BOP 4. The cut tension line L may then be unhooked from its respective tensioner 12.

The invention claimed is:

1. A subsea wellhead assembly, the assembly comprising:
a subsea wellhead;
a template associated with the wellhead;
subsea riser system equipment connected to the wellhead; and
one or more connectors,
wherein the subsea riser system equipment is connected to the template by the one or more connectors so that lateral support is provided to the subsea riser system equipment from the template,
wherein the one or more connectors extend at an angle relative to a central axis of the riser system equipment, and the angle is greater than zero degrees, and
wherein each of the one or more connectors is pretensioned to 100 kN or greater.

2. A subsea wellhead assembly as claimed in claim 1, wherein the subsea wellhead assembly is for reducing riser system induced load effects in the subsea wellhead.

3. A subsea wellhead assembly as claimed in claim 1, wherein each of the one or more connectors extends between the riser system equipment and the template.

4. A subsea wellhead assembly as claimed claim 1, wherein each of the one or more connectors is provided with a tensioner.

5. A subsea wellhead assembly as claimed in claim 4, wherein each tensioner comprises a reversal preventing device that permits movement in one direction only.

6. A subsea wellhead assembly as claimed in claim 4, wherein each tensioner has an extended position and a retracted position and is movable between the two positions so as to permit a tension to be exerted on the respective connector.

7. A subsea wellhead assembly as claimed in claim 4, wherein each of the one or more connectors is connected to the template via the respective tensioner.

8. A subsea wellhead assembly as claimed in claim 1, wherein each of the one or more connectors is provided with a force sensor.

9. A subsea wellhead assembly as claimed in claim 1, wherein each of the one or more connectors is connected to the subsea riser system equipment via a clamp.

10. A subsea wellhead assembly as claimed claim 1, wherein each of the one or more connectors is connected to the template via a bracket.

11. A subsea wellhead assembly as claimed claim 1, wherein the subsea riser system equipment is a blowout preventer.

12. A subsea wellhead assembly as claimed in claim 1, wherein the one or more connectors are supported by the template and extend at an angle of 10 degrees to 80 degrees from a substantially horizontal plane of the template towards the riser system equipment.

13. A subsea wellhead assembly as claimed in claim 1, wherein the one or more connectors are supported by the template and extend at an angle of 40 degrees to 50 degrees upwards from a substantially horizontal plane of the template towards the riser system equipment.

14. A subsea wellhead assembly as claimed in claim 1, wherein each of the one or more connectors is a line that is in tension.

15. A method of installing a subsea wellhead assembly, the method comprising:
providing a subsea wellhead, a template associated with the wellhead, and a subsea riser system equipment connected to the wellhead; and
connecting the subsea riser system equipment to the template using one or more connectors so that lateral support is provided to the subsea riser system equipment from the template, wherein the one or more connectors extend at an angle relative to a central axis of the riser system equipment, and the angle is greater than zero degrees,
wherein each of the one or more connectors is pretensioned to 100 kN or greater.

16. A method as claimed in claim 15, wherein the subsea riser system equipment is connected to the template whilst subsea.

17. A subsea wellhead assembly, the assembly comprising:
a subsea wellhead;
a template associated with the wellhead;
a blowout preventer connected to the wellhead, wherein the blowout preventer comprises a lower stack and a lower marine riser package; and
a plurality of connectors,
wherein the lower stack is connected to the template by the connectors so that lateral support is provided to the blowout preventer from the template, and the lower marine riser package is not connected to the template by the connectors,
wherein each of the connectors extends at an angle relative to a central axis of the blowout preventer, and the angle is greater than zero degrees, and
wherein the connectors are arranged to provide a total lateral support stiffness of 5E+6 N/m or greater.

18. The subsea wellhead assembly as claimed in claim 17, wherein the connectors include 4 to 8 connectors.

* * * * *